US010294761B2

(12) United States Patent
Bonner

(10) Patent No.: US 10,294,761 B2
(45) Date of Patent: May 21, 2019

(54) EROSION MODULES FOR SAND SCREEN ASSEMBLIES

(71) Applicant: Halliburton Energy Services, Inc., Houston, TX (US)

(72) Inventor: Aaron James Bonner, Flower Mound, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 771 days.

(21) Appl. No.: 14/386,010

(22) PCT Filed: Nov. 25, 2013

(86) PCT No.: PCT/US2013/071607
§ 371 (c)(1),
(2) Date: Sep. 18, 2014

(87) PCT Pub. No.: WO2015/076834
PCT Pub. Date: May 28, 2015

(65) Prior Publication Data
US 2015/0376990 A1 Dec. 31, 2015

(51) Int. Cl.
*E21B 43/08* (2006.01)
*E21B 34/06* (2006.01)

(52) U.S. Cl.
CPC ..... *E21B 43/082* (2013.01); *E21B 34/06* (2013.01); *E21B 43/08* (2013.01); *E21B 43/084* (2013.01)

(58) Field of Classification Search
CPC ..... E21B 43/08
See application file for complete search history.

(56) References Cited

U.S. PATENT DOCUMENTS 5,115,864 A * 5/1992 Gaidry ..... E21B 43/082 166/228
7,866,383 B2 1/2011 Dusterhoft et al.
7,918,272 B2 * 4/2011 Gaudette ..... E21B 34/08 166/205
8,245,778 B2 * 8/2012 Yeh ..... E21B 43/082 166/236

(Continued)

FOREIGN PATENT DOCUMENTS

WO 2015076834 A1 5/2015

OTHER PUBLICATIONS

Examination Report received in corresponding Australian Application No. 2013405873, dated Jul. 8, 2016.

(Continued)

*Primary Examiner* — Robert E Fuller
(74) *Attorney, Agent, or Firm* — McGuireWoods LLP

(57) ABSTRACT

Sand control screen assemblies can include one or more erosion-resistant modules. One sand control screen assembly includes a base pipe defining one or more flow ports that provide fluid communication into an interior of the base pipe, a well screen arranged about the base pipe and in fluid communication with the one or more flow ports via a flow path extending between the well screen and the one or more flow ports, and an erosion module arranged within the flow path and comprising an erosion-resistant material, the erosion-resistant material being configured to filter a fluid prior to the fluid entering the interior of the base pipe.

8 Claims, 4 Drawing Sheets

(56) References Cited

U.S. PATENT DOCUMENTS

| | | | | |
|---|---|---|---|---|
| 8,443,901 | B2 | 5/2013 | Moen | |
| 8,584,762 | B2 | 11/2013 | Fripp et al. | |
| 9,512,694 | B2 * | 12/2016 | Lopez | E21B 34/06 |
| 2004/0144544 | A1 | 7/2004 | Freyer | |
| 2006/0048942 | A1 | 3/2006 | Moen et al. | |
| 2006/0272814 | A1 * | 12/2006 | Broome | E21B 43/08 166/278 |
| 2011/0011586 | A1 | 1/2011 | Dusterhoft et al. | |
| 2011/0198097 | A1 | 8/2011 | Moen | |
| 2015/0129199 | A1 * | 5/2015 | Hoelscher | E03B 3/20 166/228 |

OTHER PUBLICATIONS

International Search Report and Written Opinion for PCT/US2013/071607 dated Aug. 22, 2014.

* cited by examiner

EROSION MODULES FOR SAND SCREEN ASSEMBLIES

This application a national stage filing of and claims priority to PCT/US2013/071607, filed on Nov. 25, 2013 and entitled Erosion Module for Sand Screen Assemblies.

BACKGROUND

The present disclosure is related to sand control in wellbore operations and, more particularly, to sand control screen assemblies that include one or more erosion-resistant modules.

During hydrocarbon production from subsurface formations, efficient control of the movement of unconsolidated formation particles into the wellbore, such as sand or other debris, has always been a pressing concern. Such formation movement commonly occurs during production from completions in loose sandstone or following the hydraulic fracture of a subterranean formation. Formation movement can also occur suddenly in the event a section of the wellbore collapses, thereby circulating significant amounts of particulates and fines within the wellbore. Production of these unwanted materials may cause numerous problems in the efficient extraction of oil and gas from subterranean formations. For example, producing formation particles may tend to plug the formation, production tubing, and subsurface flow lines. Producing formation particles may also result in the erosion of casing, downhole equipment, and surface equipment. These problems lead to high maintenance costs and unacceptable well downtime.

Numerous methods have been utilized to control the production of these unconsolidated formation particles during production. Sand control screen assemblies, for instance, are used to regulate and restrict the influx of formation particles. Typical sand control screen assemblies are constructed by installing one or more screen jackets on a perforated base pipe. The screen jackets include one or more drainage layers, one or more screen elements such as a wire wrapped screen or single or multi-layer wire mesh screen, and a perforated outer shroud.

While sand screens offer a solution to preventing the influx of formation sand, over time the screen jackets and/or screen elements may erode. This is especially possible in high flow rate production zones. Moreover, sand screens can be damaged at times during installation downhole, thereby rendering the filtering ability of the screens partially ineffective. As a result, the sand screen fails to perform as designed and unwanted materials are produced to the surface.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to sand control in wellbore operations and, more particularly, to sand control screen assemblies that include one or more erosion-resistant modules.

The sand control screen assemblies described herein utilize various configurations of an erosion module arranged at or near the flow ports that lead into the base pipe for delivering fluids to the surface for production. The erosion module may include or otherwise encompass an erosion-resistant material configured to serve as a redundant filter of solid particulates, fines, and/or debris originating from an adjacent formation. Such redundant filtering capabilities may prove advantageous in the event one of the well screens is damaged during run-in or otherwise becomes eroded over time and therefore ineffective. The disclosed erosion modules may also serve as depth filters, while still allowing fluid flow. However, if a breach in the one or more well screens becomes significant, the erosion module may further prove advantageous in plugging off and essentially sealing the sand control screen assembly such that damaging debris is not produced to the surface.

Figure 1:
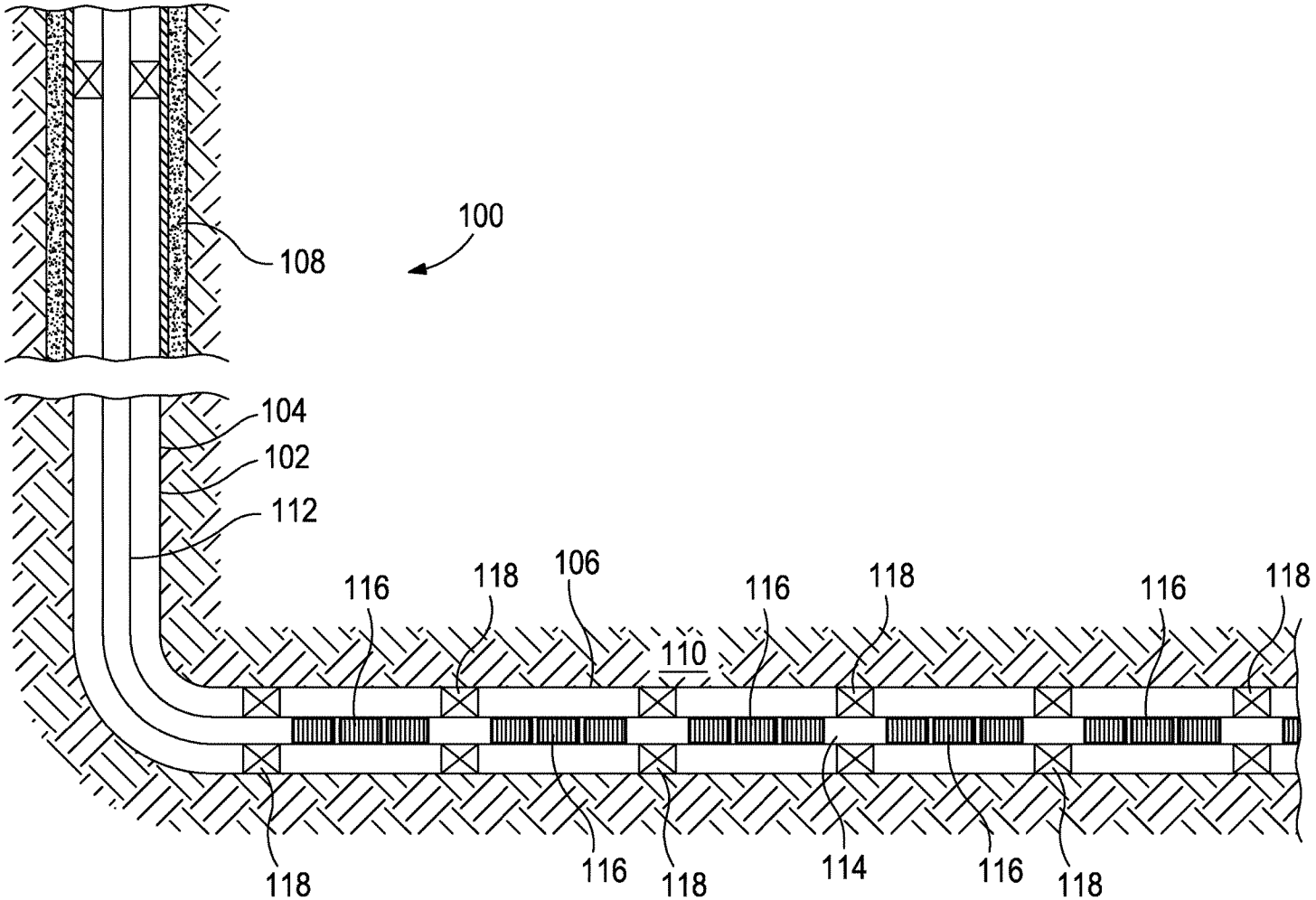
FIG. 1 depicts a well system that may employ the principles of the present disclosure, according to one or more embodiments of the disclosure.

Referring to FIG. 1, illustrated is a well system 100 that may employ the principles of the present disclosure, according to one or more embodiments of the disclosure. As depicted, the well system 100 includes a wellbore 102 that extends through various earth strata and has a substantially vertical section 104 extending to a substantially horizontal section 106. The upper portion of the vertical section 104 may have a casing string 108 cemented therein, and the horizontal section 106 may extend through a hydrocarbon bearing subterranean formation 110. In at least one embodiment, the horizontal section 106 may be arranged within or otherwise extend through an open hole section of the wellbore 102.

A tubing string 112 may be positioned within the wellbore 102 and extend from the surface (not shown). The tubing string 112 provides a conduit for fluids extracted from the formation 110 to travel to the surface. At its lower end, the tubing string 112 may be coupled to a completion string 114 arranged within the horizontal section 106. The completion string 114 serves to divide the completion interval into various production intervals adjacent the formation 110. As depicted, the completion string 114 may include a plurality of sand control screen assemblies 116 axially offset from each other along portions of the completion string 114. Each screen assembly 116 may be positioned between a pair of packers 118 that provides a fluid seal between the completion string 114 and the wellbore 102, thereby defining corresponding production intervals. In operation, the screen assemblies 116 serve the primary function of filtering particulate matter out of the production fluid stream such that particulates and other fines are not produced to the surface.

It should be noted that even though FIG. 1 depicts the screen assemblies 116 as being arranged in an open hole portion of the wellbore 102, embodiments are contemplated herein where one or more of the screen assemblies 116 is arranged within cased portions of the wellbore 102. Also, even though FIG. 1 depicts a single screen assembly 116 arranged in each production interval, it will be appreciated by those skilled in the art that any number of screen assemblies 116 may be deployed within a particular production interval without departing from the scope of the disclosure. In addition, even though FIG. 1 depicts multiple production intervals separated by the packers 118, it will be understood by those skilled in the art that the completion interval may include any number of production intervals with a corresponding number of packers 118 arranged therein. In other embodiments, the packers 118 may be entirely omitted from the completion interval, without departing from the scope of the disclosure.

While FIG. 1 depicts the screen assemblies 116 as being arranged in a generally horizontal section 106 of the wellbore 102, those skilled in the art will readily recognize that the screen assemblies 116 are equally well suited for use in wells having other directional configurations including vertical wells, deviated wellbores, slanted wells, multilateral wells, combinations thereof, and the like. The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
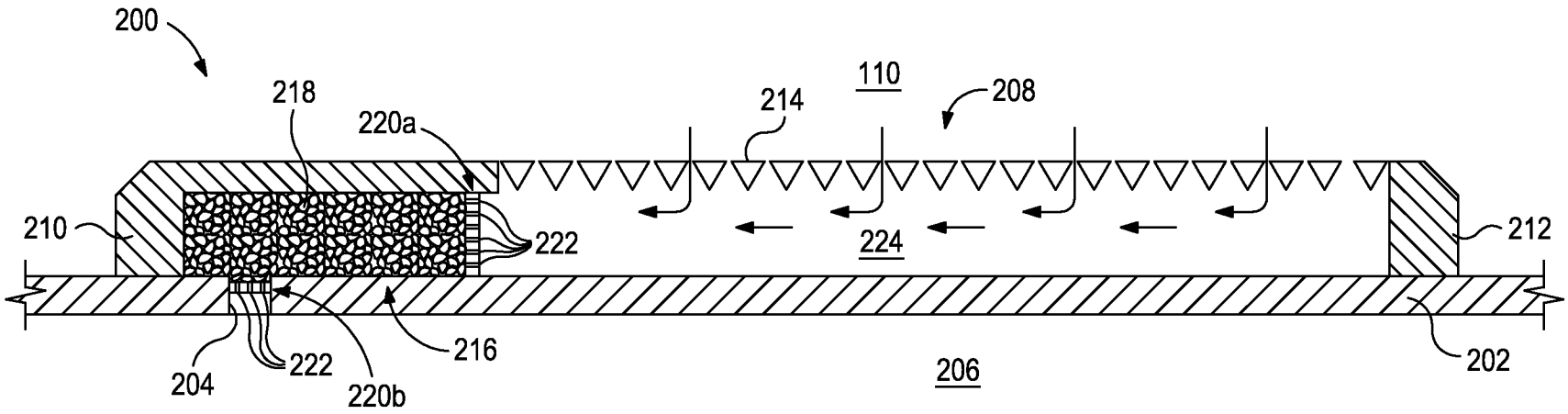
FIG. 2 illustrates an exemplary sand control screen assembly, according to one or more embodiments.

Referring now to FIG. 2, illustrated is a cross-sectional view of an exemplary sand control screen assembly 200, according to one or more embodiments. Along with the other screen assemblies described in greater detail below, the sand control screen assembly 200 may replace one or more of the screen assemblies 116 described in FIG. 1 and may otherwise be used in the exemplary well system 100 depicted therein. The screen assembly 200 may include or otherwise be arranged about a base pipe 202 that defines one or more openings or flow ports 204 configured to provide fluid communication between the interior 206 of the base pipe 202 and the formation 110. The screen assembly 200 may further include a screen jacket 208 that is attached or otherwise coupled to the exterior of the base pipe 202. In operation, the screen jacket 208 and its various components may serve as a filter medium designed to allow fluids derived from the formation 110 to flow therethrough but substantially prevent the influx of particulate matter of a predetermined size.

As illustrated, the screen jacket 208 may extend between an upper end ring 210 arranged about the base pipe 202 at its uphole end and a lower end ring 212 arranged about the base pipe 202 at its downhole end. The upper end ring 210 and the lower end ring 212 provide a mechanical interface between the base pipe 202 and the opposing ends of the screen jacket 208. Each end ring 210, 212 may be formed from a metal, such as 13 chrome, 304L stainless steel, 316L stainless steel, 420 stainless steel, 410 stainless steel, Incoloy 825, iron, brass, copper, bronze, tungsten, titanium, cobalt, nickel, combinations thereof, or the like. Moreover, each end ring 210, 212 may be coupled or otherwise attached to the outer surface of base pipe 202 by being welded, brazed, threaded, mechanically fastened, combinations thereof, or the like. In other embodiments, however, one or both of the end rings 210, 212 may be an integral part of the screen jacket 208, and not a separate component thereof.

The screen jacket 208 may further include one or more well screens 214 arranged about the base pipe 202. The screen(s) 214 may be characterized as a filter medium designed to allow fluids to flow therethrough but generally prevent the influx of particulate matter of a predetermined size. In some embodiments, the well screens 214 may be fluid-porous, particulate restricting devices made from of a plurality of layers of a wire mesh that are diffusion bonded or sintered together to form a fluid porous wire mesh screen. In other embodiments, however, the well screens 214 may have multiple layers of a weave mesh wire material having a uniform pore structure and a controlled pore size that is determined based upon the properties of the formation 110. For example, suitable weave mesh screens may include, but are not limited to, a plain Dutch weave, a twilled Dutch weave, a reverse Dutch weave, combinations thereof, or the like. In other embodiments, however, the well screens 214 may include a single layer of wire mesh, multiple layers of wire mesh that are not bonded together, a single layer of wire wrap, multiple layers of wire wrap or the like, that may or may not operate with a drainage layer. Those skilled in the art will readily recognize that several other mesh designs are equally suitable, without departing from the scope of the disclosure.

As illustrated, the well screen 214 may be radially offset a short distance from the base pipe 202 and defining a production annulus 224 therebetween. The well screen 214 may also be coupled or otherwise attached to the upper end ring 210 at its uphole end and coupled or otherwise attached to the lower end ring 212 at its downhole end. In one or more embodiments, however, the lower end ring 212 may be omitted from the screen assembly 200 and the well screen 214 may be coupled directly to the base pipe 202 at its downhole end.

The screen assembly 200 may also include an erosion module 216 arranged at or near the flow ports 204 of the base pipe 202. In the illustrated embodiment, the erosion module 216 is arranged within or substantially adjacent the upper end ring 210 but, as will be discussed below, may equally be arranged at other locations within the screen assembly 200 (or other screen assemblies), without departing from the scope of the present disclosure.

The erosion module 216 may include an erosion-resistant material 218 packed or otherwise disposed at least partially within the upper end ring 210. In some embodiments, the upper end ring 210 and the adjacent portions of the base pipe 202 may be characterized as a housing for the erosion module 216. The erosion-resistant material 218 may include any material that resists erosion from particulates and fines that may be derived from the formation 110 during production operations. In some embodiments, for example, the erosion-resistant material 218 may include ceramic beads or spheres. In other embodiments, the erosion-resistant material 218 may include, but is not limited to, a fine sintered wire mesh, sintered metal pieces or pellets, pellets or pieces of metal carbide (e.g., silicon carbide, tungsten carbide, etc.), and pellets or beads coated with any of the above-identified materials or a diamond coating. Moreover, it should be noted that none of the above-mentioned pellets are limited in shape or size.

In some embodiments, the erosion-resistant material 218 may be maintained and otherwise employed in use as a generally fluidic mass or slurry of loose or semi-loose material disposed within the erosion module 216. In order to retain the loose erosion-resistant material 218 within the erosion module 216, the erosion module 216 may further include at least a first retainer 220*a* and a second retainer 220*b*. The first retainer 220*a* may be arranged about the base pipe 202 and generally interposing the base pipe 202 and a portion of the upper end ring 210. The second retainer 220*b* may be arranged within or otherwise adjacent to the flow port 204 in the base pipe 202. Accordingly, the first and second retainers 220*a,b* may be configured to retain and hold the erosion-resistant material 218 within the erosion module 216 such that the erosion-resistant material 218 is substantially prevented from escaping. Those skilled in the art, however, will readily appreciate that additional retainers may be used in the event that the erosion module 216 extends into another leg of a screen assembly, such as in the case of a T-jointed screen assembly.

Each retainer 220*a,b* may include or otherwise have defined therein a plurality of perforations or conduits 222 configured to allow fluid flow therethrough but simultaneously prevent the escape of the erosion-resistant material 218. Accordingly, the gauge or diameter of the conduits 222 may be smaller than the diameter or size of the components that make up the erosion-resistant material 218. As a result, the erosion-resistant material 218 may be substantially isolated within the erosion module 216 while fluids may freely pass through the retainers 220*a,b* via the conduits 222.

In other embodiments, however, the erosion-resistant material 218 may be formed into a permeable or semi-permeable, solid structure. For example, in some embodiments, the erosion module 216 may be manufactured such that the erosion-resistant material 218 is formed or otherwise fashioned into a solidified or hardened structure exhibiting a predetermined shape or configuration. In other embodiments, the erosion-resistant material 218 may be introduced into the erosion module 216 as a slurry or fluidic mixture and subsequently solidified or hardened to form a semi-permeable or porous structure that provides a tortuous flow path to the flow ports 204 in the base pipe 202. The slurry of erosion-resistant material 218 may be agglomerated or otherwise bound together using one or more binding agents, adhesives, or manufacturing techniques known to those skilled in the art. In the event the erosion resistant material 218 is a hardened, solid mass, as generally described above, one or both of the first and second retainers 220*a,b* may be omitted and otherwise not used, without departing from the scope of the disclosure.

In exemplary operation, the sand control screen assembly 200 may be configured to draw in fluids from the formation 110 via the well screen 214. As indicated by the arrows, the fluid may flow into the production annulus 224 and then travel generally parallel to the base pipe 202 until reaching the erosion module 216. At the erosion module 216, the fluids may pass through the first retainer 220*a* via the conduits 222 and advance into the erosion-resistant material 218 disposed within the erosion module 216. Solid particulates, fines, and/or debris larger than the conduits 222 are prevented from passing through the first retainer 220*a*.

As indicated above, the erosion-resistant material 218 provides a tortuous flow path for fluids to traverse before locating the one or more flow ports 204. As a result additional solid particulates, fines, and/or debris that pass into the erosion module 216 may undergo a second filtering process within the erosion-resistant material 218. The fluid may eventually proceed to and otherwise locate the second retainer 220*b* and flow into the interior 206 of the base pipe 202 via the conduits 222 for production to the surface.

Accordingly, the erosion module 216 may serve as a redundant filter of solid particulates, fines, and/or debris originating from the formation 110. As will be appreciated, such redundant filtering capabilities may prove advantageous in the event the well screen 214 is damaged or otherwise eroded. As a result, a continuous and uninterrupted flow of fluids from the formation 110 is provided to the surface. The erosion module 216 may also serve as a depth filter, while still allowing fluid flow. However, if a breach in the one or more well screens 214 is significant, the erosion module 216 may further prove advantageous in plugging off and essentially sealing the sand control screen assembly 200 such that damaging debris is not produced to the surface.

While the erosion module 216 is shown in FIG. 2 as being arranged at or in a particular location within the screen assembly 200, it will be appreciated that the erosion module 216 may be arranged at any location in the fluid flow path extending between the well screen 214 and the interior 206 of the base pipe 202. For instance, the erosion module 216 may be configured to be generally arranged at or near the flow ports 204 of the base pipe 202, which may mean that the erosion module 216 is arranged entirely within the flow ports 204, partially within and without the flow ports 204, entirely without the flow ports 204 but adjacent thereto, and/or upstream from the flow ports 204 a short distance. With the benefit of the present disclosure, those skilled in the art will readily appreciate the several other locations that the erosion module 216 may be arranged, without departing from the scope of the disclosure.

Figure 3A:
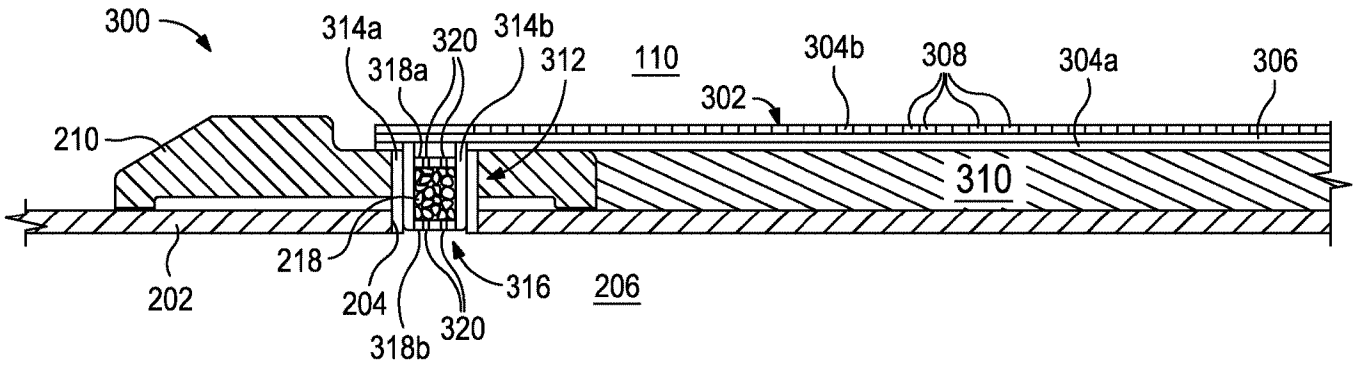
FIGS. 3A and 3B illustrate progressive cross-sectional views of another exemplary sand control screen assembly, according to one or more embodiments.
Figure 3B:
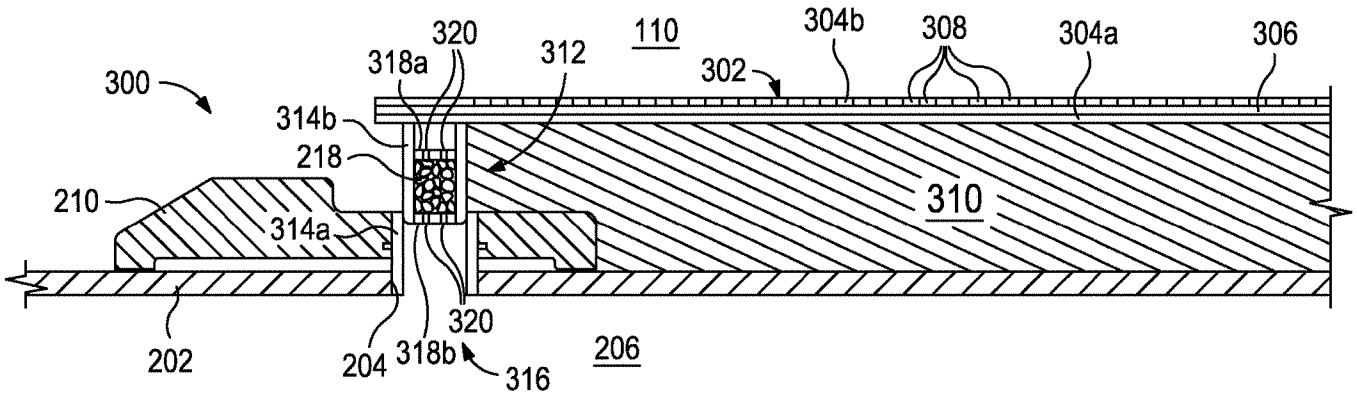

Referring now to FIGS. 3A and 3B, with continued reference to FIGS. 1 and 2, illustrated are progressive cross-sectional views of another exemplary sand control screen assembly 300, according to one or more embodiments. The screen assembly 300 may be similar in some respects to the screen assembly 200 of FIG. 2 and therefore may be best understood with reference thereto, where like numerals indicate like elements not described again in detail. The screen assembly 300 may be a swellable screen assembly configured to expand radially within a wellbore upon coming into contact with an activating fluid or otherwise upon being activated to expand.

As illustrated, the screen assembly 300 may include a filter medium in the form of one or more well screens 302 (one shown) arranged about the exterior of the base pipe 202. The well screen 302 may include a tubular housing that generally includes an impermeable bottom surface 304*a*, a screen surface 304*b*, and a flow path conduit 306 defined between the bottom and screen surfaces 304*a,b*. The tubular housing extends longitudinally from the upper end ring 210 and may have a substantially rectangular, square, circular, or kidney cross-sectional shape. The screen surface 304*b* may have several perforations 308 defined therein that allow fluids from the adjacent formation 110 to enter the well screen 302 and flow toward the flow ports 204 of the base pipe 202 within the flow path conduit 306. The screen surface 304*b* simultaneously serves to prevent the influx of particulate matter of a predetermined size.

The screen assembly 300 may further include a swellable material 310 arranged about the base pipe 202 and generally interposing the well screens 302 and the base pipe 202. More particularly, the bottom surface 304*a* of the well screen 302 may be arranged on the exterior of the swellable material 310 such that expansion of the swellable material 310 simultaneously causes the well screens 302 to radially expand. The swellable material 310 may be made of one or more materials that swell upon contact with an activating fluid, which may be any fluid to which the swellable material 310 responds by expanding. For example, the activating fluid may be, but is not limited to, hydrocarbon fluids, water, brines, a gas, or any combination thereof. The swellable material 310 may be made of, but is not limited to, a polymer, an elastic polymer, a water-swellable polymer (e.g., a water-swellable elastomer or water-swellable rubber), hydrophilic monomers, hydrophobically modified hydrophilic monomers, a salt polymer, an elastomer, a rubber, and any combination thereof.

The screen assembly 300 may further include one or more pistons 312 (one shown) used to place the flow path conduit 306 in fluid communication with the interior 206 of the base pipe 202. Each piston 312 may include a stationary portion 314*a* and a telescoping portion 314*b* . The stationary portion 314*a* may be coupled or otherwise secured to the upper end ring 210 and fluidly communicate with the flow port 204. In some embodiments, the stationary portion 314*a* may extend into the flow port 204 and may or may not be secured therein.

The telescoping portion 314*b* may be movably arranged within the stationary portion 314*a* and is otherwise configured to radially translate with respect thereto when acted upon. More particularly, the telescoping portion 314*b* may be secured to the well screen 302 such that radial expansion of the well screen 302 correspondingly causes the telescoping portion 314*b* to radially translate within the stationary portion 314*a*.

The screen assembly 300 may also include an erosion module 316 arranged within or substantially adjacent the telescoping piston 312. Similar to the erosion module 216 of FIG. 2, the erosion module 316 may include the erosion-resistant material 218. In some embodiments, the erosion-resistant material 218 may be a generally fluidic mass or slurry that requires the use of one or more retainers 318 (two shown as retainers 318*a* and 318*b*) to help retain and hold the erosion-resistant material 218 within the erosion module 316 such that the erosion-resistant material 218 is substantially prevented from escaping. Each retainer 318*a,b* may have defined therein one or more conduits 320 configured to allow fluid flow therethrough but simultaneously prevent the escape of the erosion-resistant material 218. In other embodiments, however, as described above, the erosion-resistant material 218 may be a semi-permeable solid structure secured in place for operation, without departing from the scope of the disclosure. In such embodiments, one or both of the retainers 318*a,b* may be omitted and otherwise not needed.

As illustrated, the erosion module 316 is arranged entirely within the piston 312 and, more particularly, within the telescoping portion 314*b* of the piston 312. Those skilled in the art, however, will again appreciate that the erosion module 316 may be arranged at any location in the fluid flow path extending between the well screens 302 and the interior 206 of the base pipe 202, and generally arranged at or near the flow ports 204 of the base pipe 202. For instance, the erosion module 316 may equally be arranged partially within the telescoping portion 314*b* of the piston 312 and partially within the flow path conduit 306 leading to the piston 312. In yet other embodiments, the erosion module 316 may be arranged entirely within the flow path conduit 306 upstream of the piston 312, without departing from the scope of the disclosure.

In exemplary operation, the sand control screen assembly 300 may be introduced downhole in a run-in configuration, as shown in FIG. 3A, where the swellable material 310 is in a non-swelled or contracted configuration. Upon contacting or otherwise interacting with an activating fluid, the swellable material 310 may be configured to expand into a swelled or expanded configuration, as shown in FIG. 3B. In some embodiments, the swellable material 310 may be capable of expansion upon its location in an environment having a temperature or a pressure that is above a preselected threshold in addition or alternative to an activating fluid. As the swellable material 310 expands, the well screens 302 correspondingly expand radially, thereby urging the telescoping portion 314*b* of the piston 312 to move radially with respect to the stationary portion 314*a*.

The well screens 302 may then draw in fluids from the formation 110 and into the corresponding flow conduits 306. The fluid may flow in the flow conduits 306 until reaching the erosion module 316 at which point the fluid may pass through the first retainer 318*a* (if used) via the associated conduits 320 and advance into the erosion-resistant material 218. The tortuous flow path of the erosion-resistant material 218 may serve to further filter the incoming fluid of additional solid particulates, fines, and/or debris. The fluid eventually proceeds to and otherwise locates the second retainer 318*b* (if used) and flows into the interior 206 of the base pipe 202 via the associated conduits 320.

Figure 4:
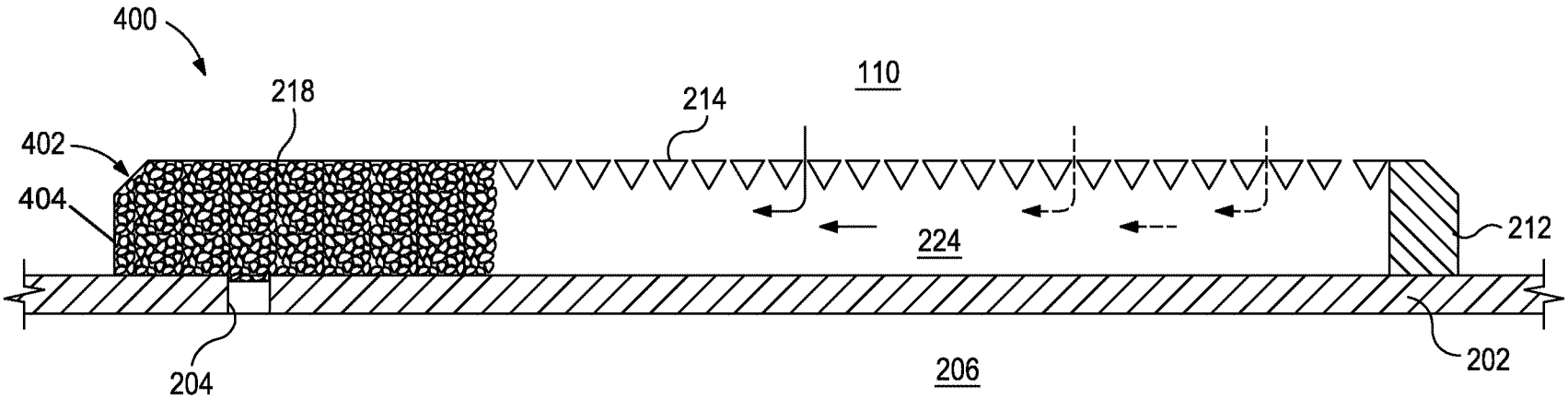
FIG. 4 illustrates another exemplary sand control screen assembly, according to one or more embodiments.

Referring now to FIG. 4, with continued reference to FIG. 2, illustrated is yet another exemplary sand control screen assembly 400, according to one or more embodiments. The screen assembly 400 may be similar in some respects to the screen assembly 200 of FIG. 2 and therefore may be best understood with reference thereto, where like numerals correspond to like elements that will not be described again in detail. As illustrated, the screen assembly 400 may be generally arranged about the base pipe 202 and may include a well screen 214 that is attached or otherwise coupled to the exterior of the base pipe 202.

Unlike the screen assembly 200, however, the screen assembly 400 does not have or otherwise include the upper end ring 210 (FIG. 2). Rather, the screen assembly 400 may employ an erosion module 402 that may serve as an upper end ring and also function as an erosion module generally described herein. More particularly, the erosion module 402 may be manufactured into a solid, hardened mass of a predetermined shape and/or configuration that is configured to be used in the screen assembly 400. As with prior embodiments, the solidified mass of erosion-resistant material 218 may be configured to provide a semi-permeable or porous structure that provides a tortuous flow path for fluids flowing to the flow ports 204 in the base pipe 202. The erosion module 402 may then be coupled or otherwise attached to the outer surface of the base pipe 202 at or near the flow ports 204 for operation.

In some embodiments, the erosion module 402 may include or have a sealant layer 404 applied to its outer surface. The sealant layer 404 may be used to generally direct fluid flow within the erosion module 402 into the flow ports 204 and otherwise not through the periphery of the erosion module 402 and back into the formation 110. The sealant layer 404 may be any material or substance capable of sealing the outer surface of the erosion module 402. For example, the sealant layer 404 may be, but is not limited to, a shroud made of one or more materials (e.g., metal, ceramic, glass, polymer, etc.), an elastomer, a polymer, a composite material, combinations thereof, and the like. In other embodiments, the sealant layer 404 may be omitted and the erosion module 402 may instead be manufactured such that its outer surface is generally a sealed surface capable of retaining fluids.

The well screen 214 may be joined to the erosion module 402 and extend therefrom to the lower end ring 212. In some embodiments, the well screen 214 may be joined to the well screen 214 via a welded or brazed interface. In other embodiments, the well screen 214 may be joined to the well screen 214 using one or more mechanical fasteners, such as screws, bolts, an interface ring, combinations thereof, and the like. Moreover, since the erosion module 402 forms a solid structure, various retainers, such as the retainers 220*a,b* of FIG. 2 or the retainers 318*a,b* of FIGS. 3A and 3B, may generally not be required in the screen assembly 400. In some embodiments, however, one or more retainers may nonetheless be used, without departing from the scope of the disclosure.

In exemplary operation, the sand control screen assembly 400 may be configured to draw in fluids from the formation 110 via the well screen 214. As indicated by the arrows, the fluid may flow into the production annulus 224 and eventually encounter the erosion module 402. The fluid may be able to penetrate the erosion module 402 and be filtered therein via the tortuous flow path provided by the erosion-resistant material 218 before eventually locating the one or more flow ports 204 and flowing into the base pipe 202 for production. Additional solid particulates, fines, and/or debris that pass into the erosion module 402 may undergo a second filtering process within the erosion-resistant material 218.

While the erosion module 402 is shown in FIG. 4 as being arranged in a particular configuration, it will be appreciated that the particular configuration or shape of the erosion module 402 may be altered. For instance, in at least one embodiment, a portion of the erosion module 402 may extend into the flow ports 204, without departing from the scope of the disclosure. In such cases, the erosion module 402 may be manufactured such that the resulting solid structure of the erosion-resistant material 218 is able to correspondingly extend at least partially into the flow ports 204.

Embodiments disclosed herein include:

A. A sand control screen assembly that includes a base pipe defining one or more flow ports that provide fluid communication into an interior of the base pipe, a well screen arranged about the base pipe and in fluid communication with the one or more flow ports via a flow path extending between the well screen and the one or more flow ports, and an erosion module arranged within the flow path and comprising an erosion-resistant material, the erosion-resistant material being configured to filter a fluid prior to the fluid entering the interior of the base pipe.

B. A method that includes drawing a fluid through a well screen arranged about a base pipe that defines one or more flow ports providing fluid communication into an interior of the base pipe, flowing the fluid in a flow path that extends between the well screen and the one or more flow ports, filtering the fluid in an erosion module arranged within the flow path and comprising an erosion-resistant material, and conveying the fluid from the erosion module into the interior of the base pipe.

Each of embodiments A and B may have one or more of the following additional elements in any combination: Element 1: wherein the erosion-resistant material is a material selected from the group consisting of ceramics, ceramic beads, ceramic spheres, wire mesh, sintered wire mesh, metal pieces or pellets, sintered metal pieces or pellets, fine sintered wire mesh, sintered metal pieces or pellets, pellets or pieces of a metal carbide, and pellets or beads coated with any of the above-identified materials. Element 2: wherein the erosion module is arranged at or near the one or more flow ports. Element 3: wherein the erosion module is arranged at least partially within at least one of the one or more flow ports. Element 4: further comprising an upper end ring arranged about the base pipe at an uphole end, and a lower end ring arranged about the base pipe at a downhole end, the erosion module being arranged at least partially radially within the upper end ring. Element 5: wherein the erosion-resistant material is a fluidic mass and the assembly further comprises a first retainer arranged about the base pipe and interposing the base pipe and a portion of the upper end ring, a second retainer arranged at or within one of the one or more flow ports, and one or more conduits defined in each of the first and second retainers, the one or more conduits being sized and configured to allow fluid flow therethrough and prevent the erosion-resistant material from escaping the erosion module. Element 6: further comprising a swellable material arranged about the base pipe and interposing the well screen and the base pipe, a piston arranged in at least one of the flow ports, the piston comprising a stationary portion and a telescoping portion movably arranged within the stationary portion such that when the swellable material expands, the telescoping portion correspondingly translates radially with respect to the stationary portion, wherein the erosion module is arranged at least partially within the telescoping portion. Element 7: wherein the erosion-resistant material is a fluidic mass and the assembly further comprises at least one retainer included in the erosion module to retain the erosion-resistant material therein and prevent its escape, and one or more conduits defined in the at least one retainer and being sized and configured to allow fluid flow therethrough. Element 8: wherein the erosion module is arranged entirely within the telescoping portion of the piston and the at least one retainer comprises first and second retainers disposed on opposing ends of the erosion module in order to retain the erosion-resistant material therein. Element 9: wherein the erosion-resistant material is or is formed into a permeable or semi-permeable solid structure. Element 10: wherein the erosion-resistant material is or is formed into a permeable or semi-permeable solid structure coupled to an outer surface of the base pipe. Element 11: wherein the erosion module further includes a sealant layer applied to an outer surface of the erosion-resistant material, the sealant layer being configured to direct fluid flow within the erosion module into the one or more flow ports and otherwise prevent the fluid flow from passing through the outer surface of the erosion-resistant material.

Element 12: wherein the erosion module is arranged radially within an upper end ring arranged about the base pipe at an uphole end thereof, and wherein filtering the fluid in the erosion module further comprises drawing the fluid into the erosion module through a first retainer arranged about the base pipe and interposing the base pipe and a portion of the upper end ring, filtering the fluid as it passes through the erosion-resistant material, and ejecting the fluid from the erosion module via a second retainer arranged at or within the one or more flow ports. Element 13: wherein the erosion-resistant material is a fluidic mass and wherein each of the first and second retainers provides one or more conduits defined therein, the method further comprising preventing the erosion-resistant material from escaping the erosion module with the first and second retainers. Element 14: wherein a swellable material is arranged about the base pipe and interposes the well screen and the base pipe, and a piston is arranged in at least one of the flow ports and includes a stationary portion and a telescoping portion movably arranged within the stationary portion, the method further comprising expanding the swellable material, and allowing the telescoping portion to translate radially with respect to the stationary portion as the swellable material expands, wherein the erosion module is arranged at least partially within the telescoping portion. Element 15: wherein the erosion-resistant material is a fluidic mass and filtering the fluid in the erosion module further comprises drawing the fluid into the erosion module through a first retainer, filtering the fluid as it passes through the erosion-resistant material, ejecting the fluid from the erosion module via a second retainer, wherein each of the first and second retainers provide one or more conduits defined therein, and preventing the erosion-resistant material from escaping the erosion module with the first and second retainers. Element 16: further comprising arranging the erosion module entirely within the telescoping portion of the piston, wherein the first and second retainers are disposed on opposing ends of the erosion module. Element 17: wherein the erosion-resistant material is or is formed into a permeable or semi-permeable solid structure and filtering the fluid in the erosion module further comprises drawing the fluid into the erosion module, filtering the fluid as it passes through the erosion-resistant material, and ejecting the fluid from the erosion module and into the interior of the base pipe. Element 18: wherein the erosion-resistant material is a permeable or semi-permeable solid structure coupled to an outer surface of the base pipe, and wherein filtering the fluid in the erosion module further comprises drawing the fluid into the erosion module, filtering the fluid as it passes through the erosion-resistant material, preventing the fluid from passing through an outer surface of the erosion-resistant material with a sealant layer applied to the outer surface of the erosion-resistant material, and directing fluid flow within the erosion module into the one or more flow ports with the sealant layer applied to the outer surface of the erosion-resistant material.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A sand control screen assembly, comprising:

a base pipe defining one or more flow ports that provide fluid communication into an interior of the base pipe;

a well screen arranged about the base pipe and in fluid communication with the one or more flow ports via a flow path extending between the well screen and the one or more flow ports;

an erosion module arranged within the flow path and comprising:

an erosion-resistant material selected from the group consisting of ceramic beads, ceramic sphres, a wire mesh, a sintered wire mesh, metal pieces or pellets, sintered metal pieces or pellets, a find sintered wire mesh, pellets or pieces of a metal carbide, and pellets or beads coated with erosion-resistant materials;

a first retainer disposed within one of the one or more flow ports, the first retainer positioned along the flow path and in between the well screen and the erosion-resistant material, wherein the first retainer comprises one or more perforations that filter fluid flowing along the flow path after the fluid is filtered by the well screen and before the fluid is filtered by the erosion-resistant material; and a second retainer arranged about the base pipe, wherein the erosion-resistant material is held packed and retained between the first retainer and the second retainer, and wherein the second retainer comprises one or more perforations that filter fluid flowing along the flow path after the fluid is filtered by the erosion-resistant material.

2. The assembly of claim 1, wherein the erosion module is arranged at or near the one or more flow ports.

3. The assembly of claim 1, wherein the erosion module is arranged at least partially within at least one of the one or more flow ports.

4. The assembly of claim 1, further comprising:

an upper end ring arranged about the base pipe at an uphole end; and a lower end ring arranged about the base pipe at a downhole end, the erosion module being arranged at least partially radially within the upper end ring.

5. The assembly of claim 4, wherein the second retainer interposes the base pipe and a portion of the upper end ring, and one or more conduits is defined in each of the first and second retainers, the one or more conduits being sized and configured to allow fluid flow therethrough and prevent the erosion-resistant material from escaping the erosion module.

6. A method, comprising:

drawing a fluid through a well screen arranged about a base pipe that defines one or more flow ports providing fluid communication into an interior of the base pipe;

flowing the fluid in a flow path that extends between the well screen and the one or more flow ports;

after flowing the fluid through the one or more perforations of the first retainer, filtering the fluid in an erosion module arranged within the flow path the erosion module comprising an erosion-resistant material selected from the group consisting of ceramic beads, ceramic spheres, a wire mesh, a sintered wire mesh, metal pieces or pellets, sintered metal pieces or pellets, a fine sintered wire mesh, pellets or pieces of a metal carbide, and pellets or beads coated with an erosion-resistant materials, a first retainer having one or more perforations and positioned along the flow path and in between the well screen and the erosion-resistant material, and a second retainer having one or more perforations, wherein filtering the fluid in the erosion module comprises:

filtering the fluid through the one or more perforations of the first retainer;

after filtering the fluid through the first retainer; filtering the fluid through the erosion-resistant material; and after filtering the fluid through the erosion-resistant material, filtering the fluid through the one or more perforations of the second retainer;

after flowing the fluid in the erosion module;

conveying the fluid from the erosion module into the interior of the base pipe;

ejecting the fluid from the erosion module via a first retainer within the one or more flow ports; and retaining the erosion-resistant materials between the first retainer and a second retainer arranged about the base pipe, wherein the erosion-resistant material is packed between the first retainer and the second retainer.

7. The method of claim 6, wherein the erosion module is arranged radially within an upper end ring arranged about the base pipe at an uphole end thereof, and wherein filtering the fluid in the erosion module further comprises:

drawing the fluid into the erosion module through the second retainer interposing the base pipe and a portion of the upper end ring; and filtering the fluid as it passes through the erosion-resistant material.

8. The method of claim 7, wherein each of the first and second retainers provides one or more conduits defined therein, the method further comprising preventing the erosion-resistant material from escaping the erosion module with the first and second retainers.

* * * * *